US005695046A

United States Patent [19]

Turner et al.

[11] Patent Number: 5,695,046

[45] Date of Patent: Dec. 9, 1997

[54] MOTOR OPERATOR WITH BURN-OUT PROTECTION

[75] Inventors: David C. Turner, North Fayette; Craig J. Puhalla, Moon Township, both of Pa.

[73] Assignee: Eaton Corporation, Cleveland, Ohio

[21] Appl. No.: 699,305

[22] Filed: Aug. 19, 1996

[51] Int. Cl.[6] ..... H01H 3/20

[52] U.S. Cl. ..... 200/330; 200/332.1

[58] Field of Search ..... 200/400, 401, 200/330, 332.2, 331, 329, 332.1

[56] References Cited

U.S. PATENT DOCUMENTS

| | | | |
|---|---|---|---|
| 5,196,658 | 3/1993 | Gula | 200/50 |
| 5,354,960 | 10/1994 | Erickson | 200/400 |
| 5,475,190 | 12/1995 | Smith et al. | 200/330 |
| 5,504,290 | 4/1996 | Baginski et al. | 200/330 |

OTHER PUBLICATIONS

Installation Instructions for Motor Operator for 3— and 4—Pole ND, NB, NC, MD, MA, MC Type Circuit Breakers and Molded Case Switches, I.L. 29C204B, Aug. 1995, Eaton, Cutler-Hammer, Westinghouse & Cutler-Hammer Products, Style No. 6634C87H02 (supersedes I.L. 299C204A dated Nov. 1993).

*Primary Examiner*—David J. Walczak
*Attorney, Agent, or Firm*—Martin J. Moran

[57] ABSTRACT

A motor operator for a circuit breaker has a motor driven carriage which engages a circuit breaker handle and drives it between an on position and a reset position beyond off. When the carriage drives the handle to the off/reset position, an off limit switch is actuated to deenergize the motor. A fastener releasably secures a bracket slidably mounted on the carriage to a fixed member when the carriage reaches the reset position of the handle so that if the circuit breaker does not reset and rebounds toward a trip position, the bracket is extended and maintains actuation of the off limit switch. Hence, the motor is not repeatedly energized and burned out in unsuccessful attempts to reset the circuit breaker.

8 Claims, 6 Drawing Sheets

MOTOR OPERATOR WITH BURN-OUT PROTECTION

BACKGROUND OF THE INVENTION

1. Field of the Invention

This invention relates to motor operators for electrically positioning the handle of an electrical switch such as a circuit breaker. More particularly, it relates to such a motor operator with a device which prevents repeated unsuccessful attempts to reset the circuit breaker.

2. Background Information

Electrical switches, such as circuit breakers, typically have a handle by which the contacts of the circuit breaker can be manually opened and closed. They can also be automatically opened, or tripped, in response to currents which exceed defined amplitude/time-characteristics. In many such circuit breakers, the handle must be moved beyond the off position to a reset position following a trip before the handle can be returned to the on position. Often, the handle is spring biased to a position between off and on when the circuit breaker is tripped to provide a visual indication of the tripped condition.

In many applications, a motor operator is provided to position the circuit breaker handle. The motor operator makes it easier to operate large circuit breakers and also provides the capability for remote operation of the circuit breaker. An example of a common type of motor operator is described in U.S. Pat. No. 5,196,658. Such motor operators have a carriage which engages the handle of the circuit breaker. The carriage is reciprocally driven to move the handle to the on and off/reset positions by a threaded shaft which is rotated by an electric motor. The power circuit for the electric motor includes on and off limit switches which are actuated when the carriage has driven the handle to the on and off/reset positions respectively to terminate energization of the motor. In certain cases, the motor does not have sufficient torque to reset the circuit breaker when starting from the tripped position. In these cases, the handle should be first moved to the on position so that the motor operator generates sufficient inertia to reset the circuit breaker. If the circuit breaker is not reset, the springs biasing the handle to the intermediate tripped position cause the carriage to rebound from the off/reset position toward the trip position by a distance which results in deactuation of the off limit switch. This results in reenergization of the motor with a polarity which again drives the carriage toward the off/reset position. This results in reactuation of the off limit switch to deenergize the motor, but since the motor lacks sufficient torque to reset the circuit breaker, the carriage again rebounds deactuating the off limit switch. Thus, the motor repetitively tries to reset the breaker eventually causing burn-out of the motor.

There is a need therefore for an improved motor operator for operating the handle of electrical switches such as circuit breakers.

More particularly, there is a need for such an improved motor operator which does not permit cycling of the motor operator motor if the circuit breaker does not reset.

SUMMARY OF THE INVENTION

These needs and others are satisfied by the invention which is directed to a motor operator for a circuit breaker having a handle moveable from an on position, through a trip position to an off position and beyond the off position to a reset position for resetting the circuit breaker following a trip. The handle is spring biased toward the trip position from the off position until the circuit breaker is reset following a trip. The motor operator includes a carriage engaging the circuit breaker handle and mounted for reciprocal movement along a longitudinal axis for operating the handle between the on and reset positions. An electric motor reciprocally drives the carriage when energized. The electric motor is energized by a power circuit including an off limit switch which is actuated by the carriage with the handle in the off/reset position to deenergize the electric motor when the circuit breaker is reset. However, this switch is normally unactuated when the handle and therefore the carriage rebound toward the trip position when the circuit breaker does not reset. In accordance with the invention, override means maintains actuation of the off limit switch when the handle, and therefore the carriage, rebound toward the trip position following an unsuccessful attempt to reset the circuit breaker. The override means comprises first means secured to the housing and second means secured to the carriage which releasably engage to maintain the off limit switch actuated when the circuit breaker does not reset. One of these first and second means comprises a first member of a releasable fastener and the other of the first and second means comprises a bracket, means slidably mounting the bracket for movement parallel to the longitudinal axis, and a second member of the releasable fastener provided on the bracket. The first and second members of the releasable fastener engage as the carriage travels toward the reset position and remain engaged as the carriage rebounds when the circuit breaker does not reset. Under these conditions, the bracket slidably extends to engage and maintain the off limit switch actuated so that the motor can not be reenergized upon rebound of the carriage. The first and second members of the releasable fastener disengage when the carriage is driven toward the on position by the electric motor thereby deactuating the off limit switch for the next cycle. Preferably, the one of the first and second means is the first means and the other is the second means so that the bracket is slidably mounted on the carriage. Biasing means such as a spring bias the bracket toward the carriage so that when the releasable fastener disengages, the bracket is retracted against the carriage.

BRIEF DESCRIPTION OF THE DRAWINGS

A full understanding of the invention can be gained from the following description of the preferred embodiment when read in conjunction with the accompanying drawings in which.

DESCRIPTION OF THE PREFERRED EMBODIMENT

Figure 1:
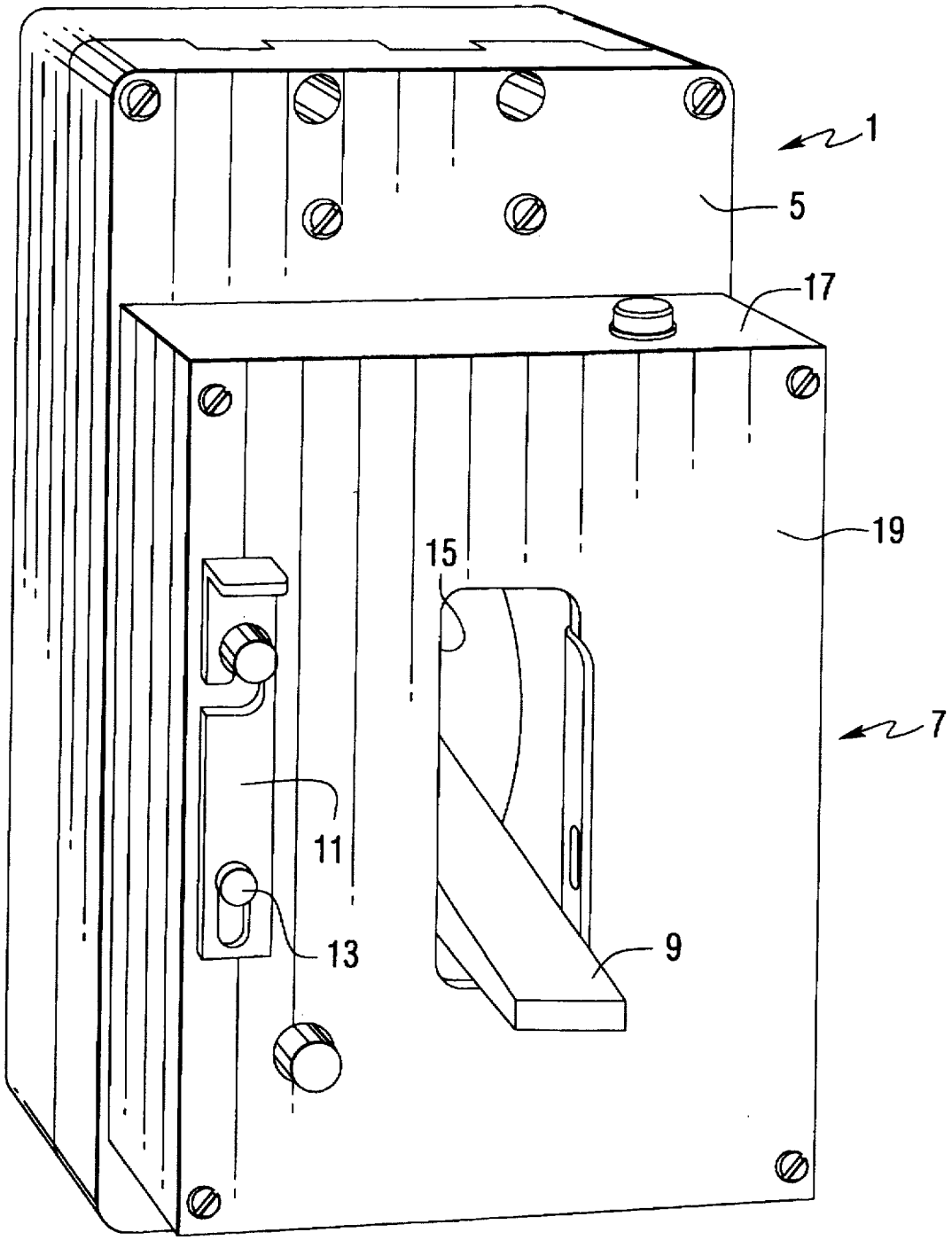
FIG. 1 is an isometric view of a circuit breaker with a motor operator incorporating the invention.
Figure 2:
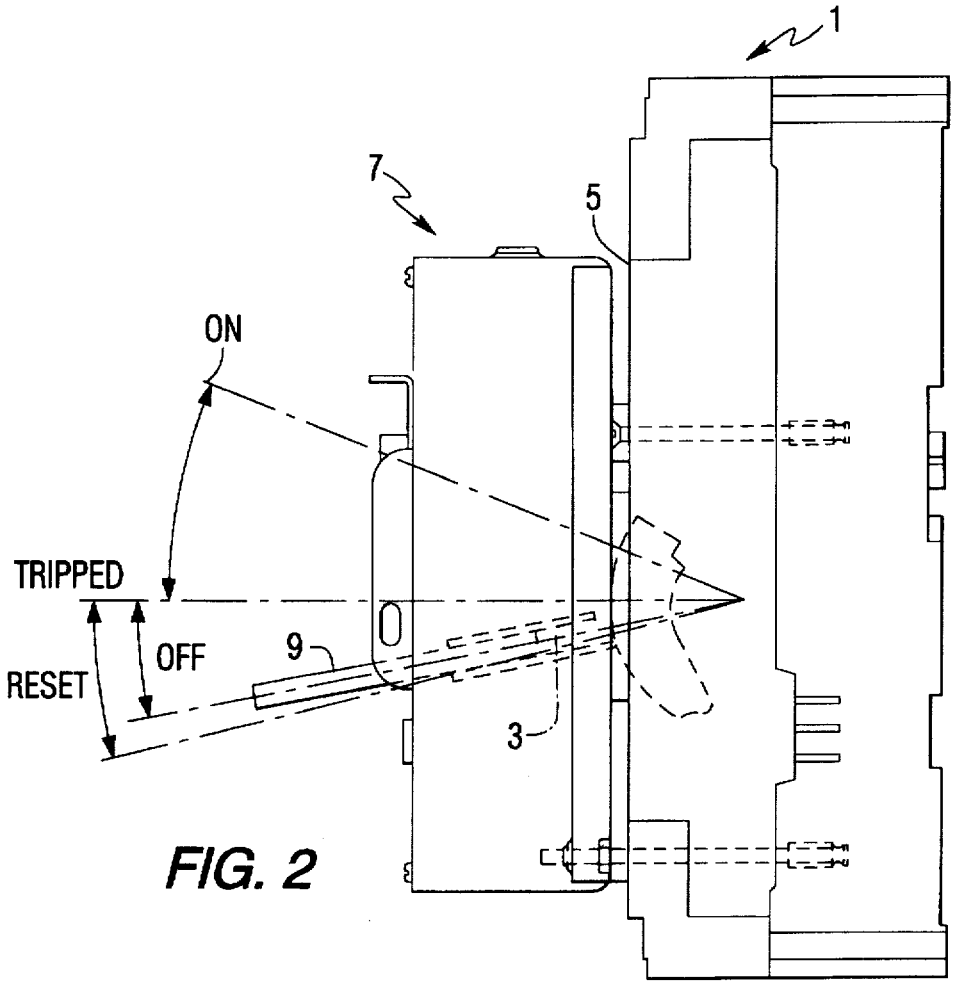
FIG. 2 is a side elevation view of the circuit breaker and motor operator of FIG. 1 illustrating operation of the circuit breaker handle.

FIGS. 1 and 2 illustrate a circuit breaker 1 such as a well known low voltage molded case circuit breaker. The circuit breaker 1 has a handle 3 projecting from a front face 5. The handle 3 moves in an arcuate path between an on position in which power contacts (not shown) within the circuit breaker are closed and an off position in which the power contacts are open. As is well known, the circuit breaker also includes a trip mechanism (not shown) which responds to certain currents/time characteristics of load current passing through the circuit breaker to automatically trip the power contacts open. When this occurs, the handle 3 assumes a tripped position which is intermediate the off and on positions. In order to reset the circuit breaker so that it can be returned to the on position, the handle must be moved beyond the off position to a reset position which mechanically resets the trip mechanism. If the trip mechanism resets, the handle returns to the off position when released. On the other hand, if the trip mechanism does not reset, when the handle is released, it will return to the tripped position.

While the handle of the circuit breaker is normally operated manually, a motor operator 7 provides the capability for remote operation. The motor operator 7 is bolted to the front face of the circuit breaker 1 over the handle 3. The handle is provided with an extension 9 which protrudes through the front face of the motor operator so that the circuit breaker can still be alternatively manually operated. A mechanical interlock 11 pivotally mounted to the motor operator by pin 13, can be raised up from the stored position shown in FIG. 1 and rotated clockwise to extend across the handle slot 15 in the motor operator to lock the circuit breaker in the off position as is well known.

Figure 3:
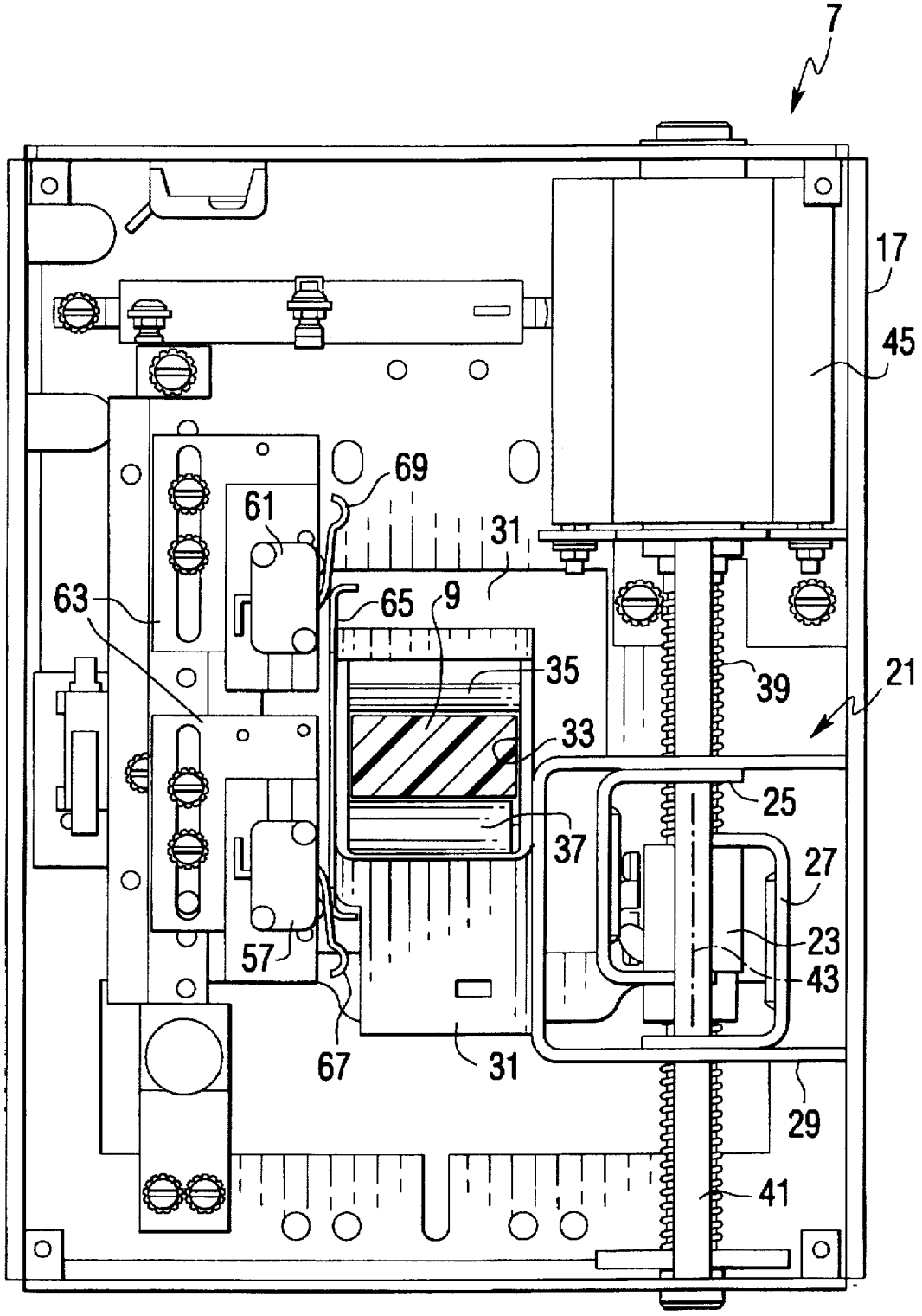
FIG. 3 PRIOR ART
FIG. 3 is a plan view of a motor operator without the benefit of the invention shown with the cover removed and with the handle in the tripped position with the end portion removed for clarity.
Figure 5:
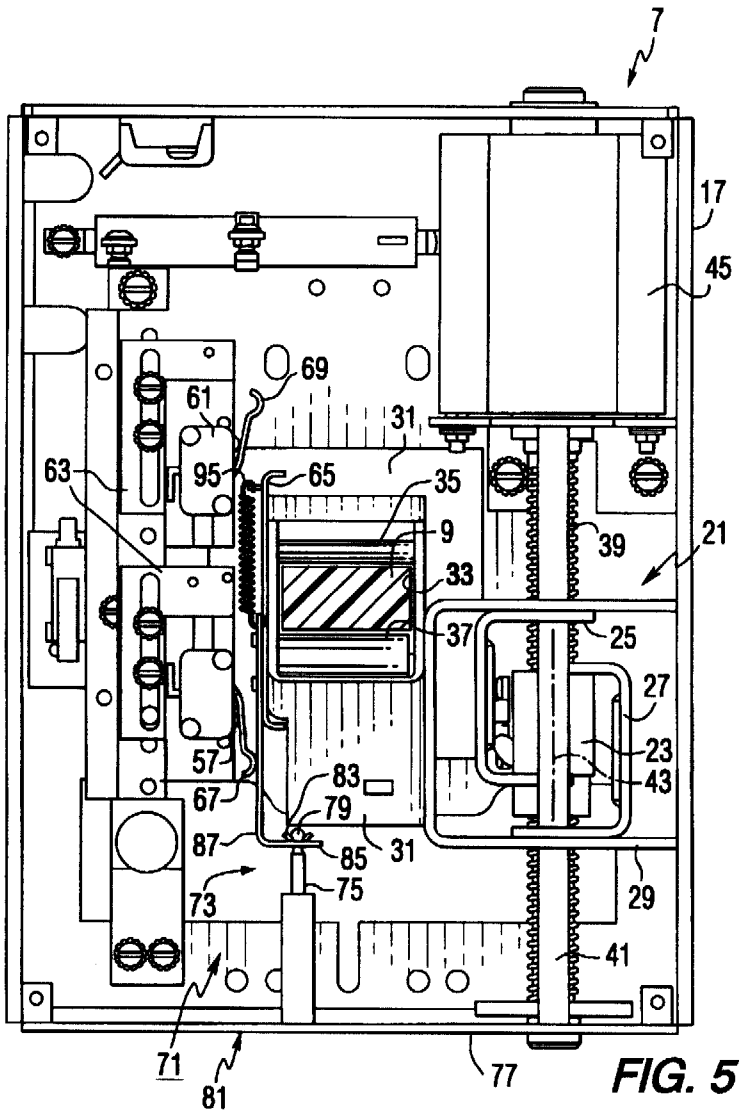
FIG. 5 a plan view similar to that of FIG. 4 showing the handle in the trip position.
Figure 4:
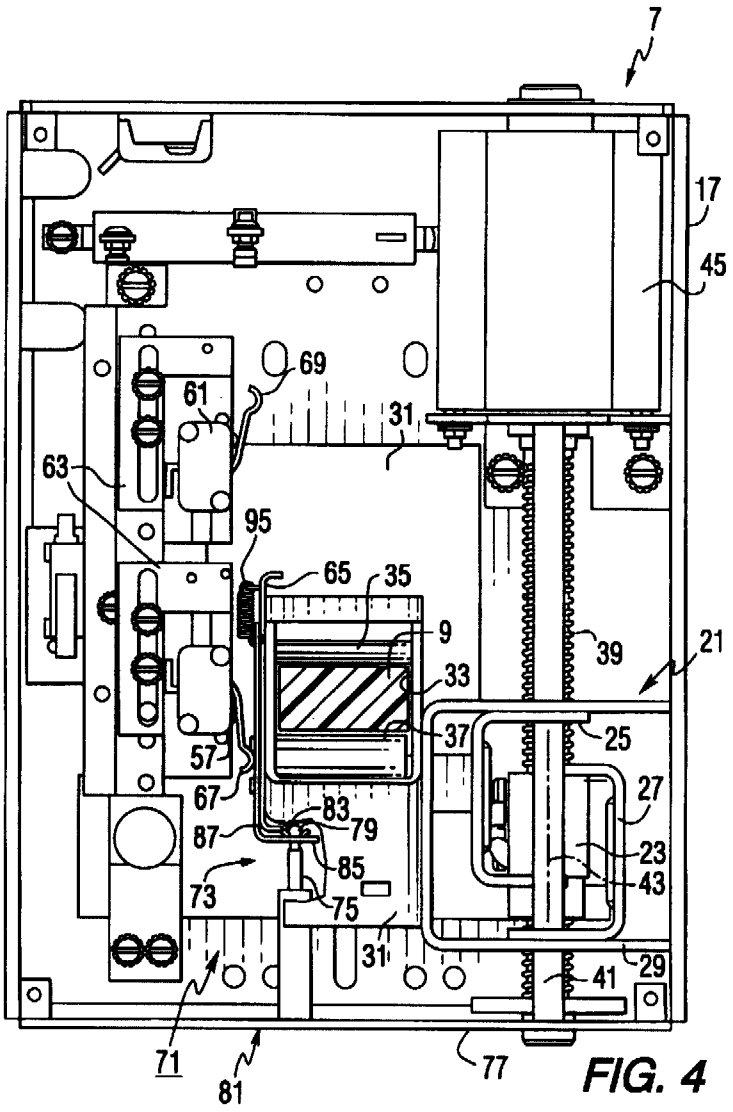
FIG. 4 illustrates a plan view with the cover removed of the motor operator incorporating the invention, again with the end portion removed for clarity, showing the handle in the off position.

As shown in FIGS. 3–5, the motor operator 7 includes an enclosure 17 shown with the lid 19 (see FIG. 1) removed. Within the enclosure 17 is a carriage assembly 21 which includes a bail nut 23 supported by two U-shaped brackets 25 and 27 mounted within a larger U-shaped bracket 29. The carriage assembly 21 further includes a plate 31 extending laterally from the U-shaped bracket 29 and having an opening 33 through which the handle extension 9 (not shown in FIG. 3) extends. Supported on the carriage assembly 21 adjacent the opening 33 are a pair of spaced apart rollers 35 and 37 which bear against sides of the handle extension 9.

The carriage assembly 21 is mounted on a threaded rod 39 and a parallel guide rod 41 for reciprocal movement, along a longitudinal axis 43 defined by the threaded rod 39 and a guide rod 41. A reversible electric motor 45 rotates the threaded rod 39 in either direction to reciprocally drive the carriage assembly 21 along the longitudinal axis 43. Thus, by operation of a motor 45 the handle of the circuit breaker can be driven to the on (up) position or the reset (down) position.

Figure 8:
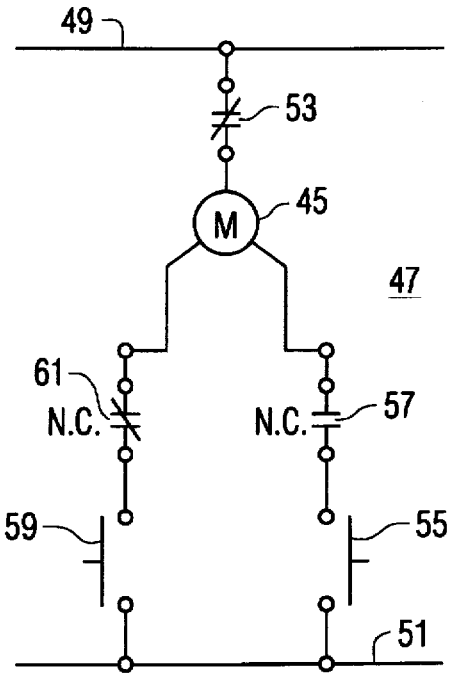
FIG. 8 is a schematic diagram of pertinent portions of the power circuit for the motor operator.

The power circuit 47 for the electric motor 45 is shown in FIG. 8. The motor 45 is energized by a pair of power leads 49 and 51. The motor 45 is connected through an interlock limit switch 53 to the power lead 49. The interlock limit switch 53 must be closed in order for the circuit breaker to be electrically operated. The motor may be operated to drive the carriage assembly to the off position by actuation of an off push button 55 which connects the motor 45 to the power lead 51 through an off limit switch 57. The off limit switch 57 is a normally closed (N.C.) switch which as shown, interrupts current flow to the motor when the switch handle reaches the off/reset position and opens the switch. The motor 45 is energized to rotate in the opposite direction by actuation of an on push button 59 which connects the motor to the power lead 51 through the on limit switch 61. The on limit switch 61 is also a normally closed (N.C.) switch which is opened when the switch handle reaches the on position to deenergize the motor 45.

Returning to FIG. 3, the off limit switch 57 and on limit switch 61 are mounted on brackets 63 adjacent the carriage assembly 21. An actuating plate 65 has curved ends which engage the actuating lever 67 and 69 of the switches 57 and 61 respectively as the carriage assembly reaches its limits of travel. Thus, when the carriage assembly 21 reaches the off/reset position near the bottom of the enclosure in FIG. 3, the actuation plate 65 engages the actuating lever 67 to actuate the off limit switch 57 and deenergize the motor 45. Similarly, when the carriage assembly reaches its upper limit of travel and has turned the circuit breaker on, the actuating plate 65 engages the actuating lever 69 to actuate the on limit switch 61 and turn off the motor 45.

When the circuit breaker trips, the handle is spring biased to the intermediate trip position. The ball nut 23 has very low friction so that the carriage assembly 21 is driven by the handle toward an intermediate position which is shown in FIG. 3. As can be seen from FIG. 3, with the handle and carriage in the intermediate position, both the off limit switch 57 and on limit switch 61 are unactuated thereby permitting either push button to be used to energize the motor 45. As explained, the handle must be moved to the reset position before the circuit breaker can be again turned on. However, it has been found that the motor 45 typically used is not powerful enough to reset the circuit breaker starting from the intermediate position. Therefore, it is recommended that the on push button 59 be actuated first to drive the carriage toward the on position so that then when the off push button is actuated the motor and carriage assembly can generate sufficient inertia to reset the circuit breaker. If the user ignores or is unaware of these instructions, and attempts to reset the circuit breaker from the tripped position, the motor will be deenergized when the off limit switch 57 is actuated; however, without reset, the spring in the circuit breaker will drive the handle back to the tripped position dragging the carriage assembly with it. This deactuates the off limit switch 57 as shown in FIG. 3. If the user repeatedly attempts to electrically reset the circuit breaker, the motor can overheat and be damaged.

Figure 6:
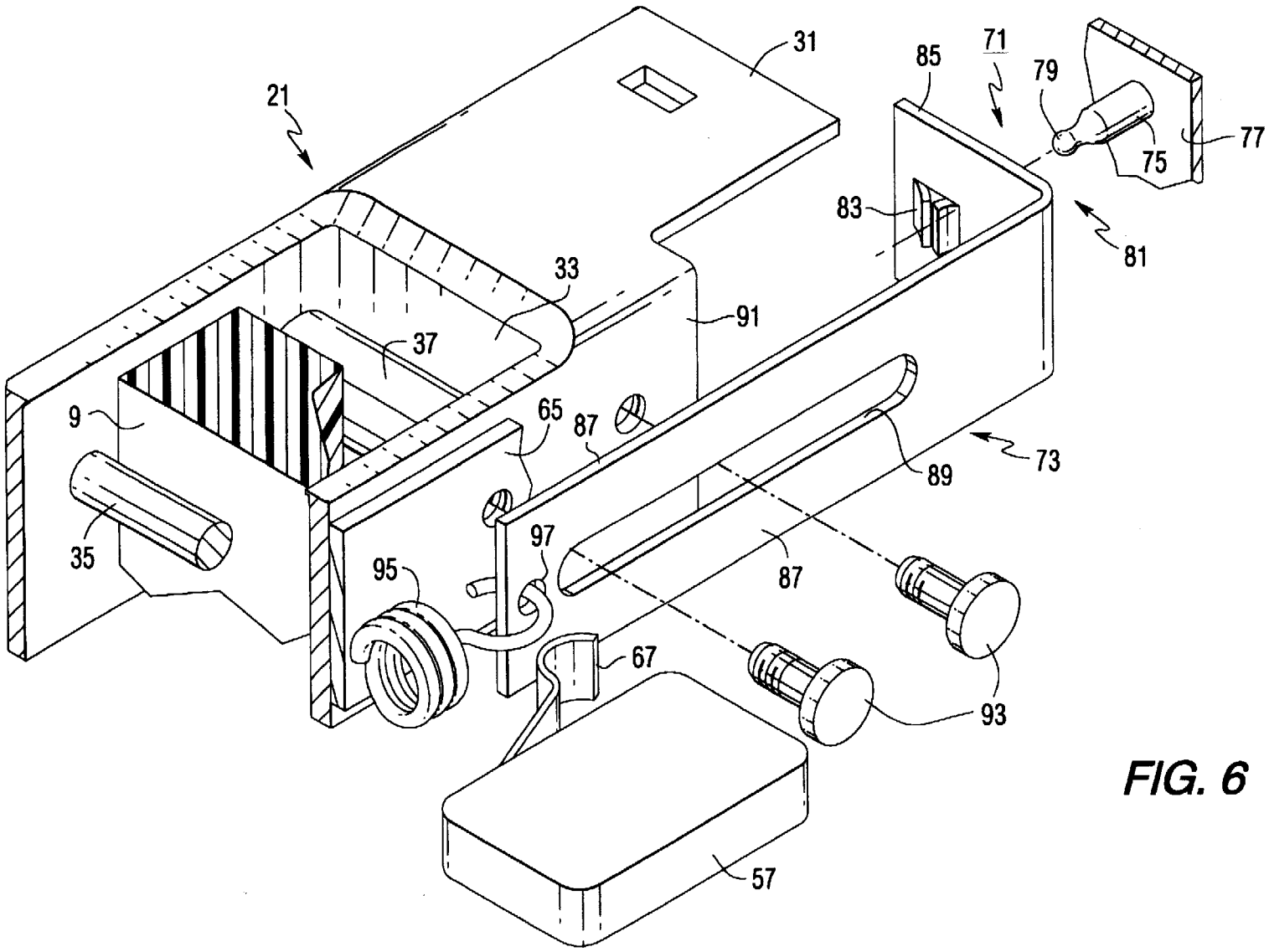
FIG. 6 an isometric view of the override device in accordance with the invention and portion of the carriage on which it is mounted.

The present invention prevents repeated unsuccessful attempts to reset the circuit breaker starting from the tripped position. As shown in FIGS. 4–6, an override device 71 is mounted on the carriage assembly 21 to maintain actuation of the off limit switch 57 when the handle 3, and therefore, the carriage rebound toward the trip position following an unsuccessful attempt to reset the circuit breaker. This override device 71 includes a first member 73 in the form of an L-shaped bracket and a second member 75 mounted on the bottom wall 77 of the enclosure 17. The second member 75 is in the form of a stud having an enlarged head 79 which forms the male part of a releasable fastener 81 which also includes a female part formed by a pair of tabs 83 punched out of the flange 85 on the L-shaped bracket 73. The main section 87 of the L-shaped bracket 73 has an elongated slot 89 extending longitudinally therein. The bracket 73 is slidably connected to a depending flange 91 on the plate 31 of the carriage assembly 21 by a pair of guides in the form of bolts 93. A helical tension spring 95 hooked in an aperture 97 in the end of the elongated section 87 and at the other end to a tab 99 on the flange 91 biases the L-shaped bracket 73 against the carriage assembly 21. When the carriage, and therefore, the handle are driven toward the reset (lower) position, the male part 75 of the releasable fastener 81 engages the female part 83 to releasably secure the L-shaped bracket 73 to the male part 75 as shown in FIG. 4. Then, if the circuit breaker does not reset and the carriage rebounds with the handle to the trip position as shown in FIG. 5, the L-shaped bracket 73 remains attached to the male part 75 and extends to the carriage assembly so that the off limit switch 57 remains actuated. As it will be recalled, with the normally closed off limit switch 57 actuated, the motor 45 cannot be energized to drive the carriage in the off direction. Only the on push button 61 is effective to drive the motor under these conditions as the on limit switch 61 remains unactuated. As can be seen from FIG. 5, the carriage assembly is in the same position as in FIG. 3, so that without the override device 71, the off limit switch would not be actuated permitting the handle to again be driven toward off/reset.

Figure 7A:
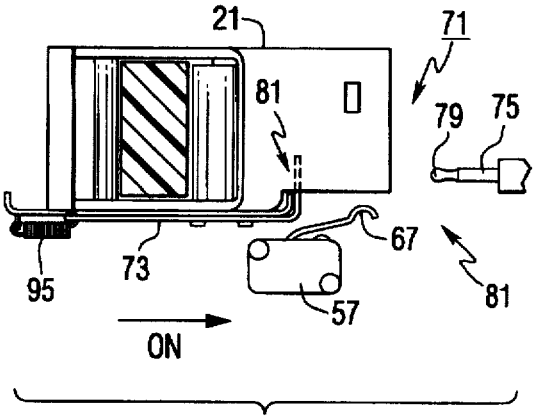
FIGS. 7*a–e* illustrates schematically the operation of the invention.
Figure 7B:
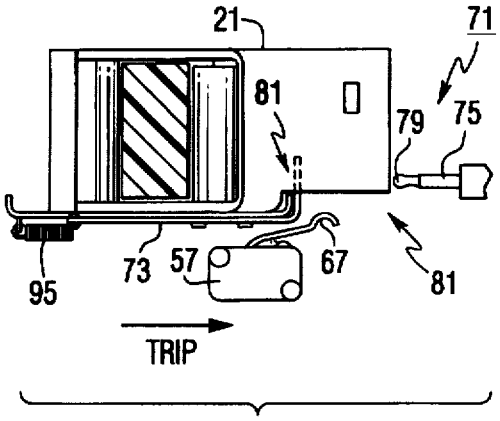
Figure 7C:
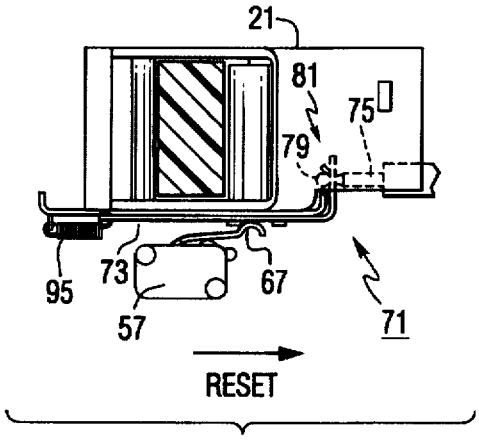
Figure 7D:
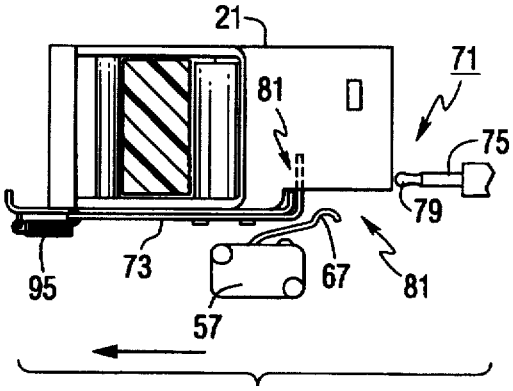
Figure 7E:
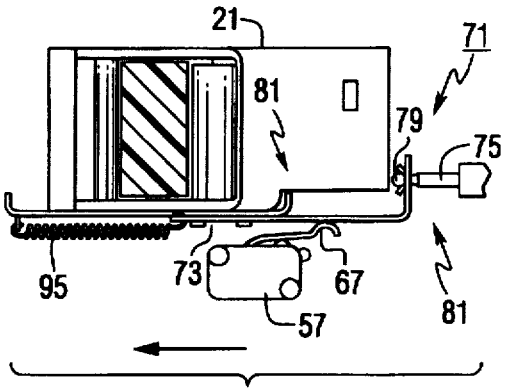

FIGS. 7*a* through 7*e* schematically illustrate operation of the motor operator with the invention. FIG. 7*a* shows the carriage assembly 21 in the on position in which the L-shaped bracket 73 is in a retracted position against the carriage assembly 21 and the off limit switch 57 is unactuated. Thus, the motor can be operated to drive the carriage, and therefore the handle, toward the off position. If the circuit breaker trips, the carriage is moved to the intermediate position shown in 7*b* in which the off limit switch 57 remains unactuated. As noted, users are advised to actuate the on push button 59 to move the handle to the on position before actuating the off push button so that enough inertia will be generated by the carriage assembly to reset the circuit breaker. However, with the circuit breaker tripped as shown in FIG. 7*b*, it is possible for the motor to be energized to drive the handle toward the off reset position. When the reset position is reached as indicated in FIG. 7*c*, the releasable fastener 81 will engage to releasably secure the bracket 73 to the male portion 75. If the circuit breaker does not reset, and the handle and carriage rebound to the trip position as shown in FIG. 7 the bracket remains secured to the male member 75 and therefore is extended from the carriage assembly to maintain actuation of limit switch 57. Thus, the operator will be unable to repeatedly drive the carriage assembly from the tripped position to the off reset position. Therefore, the on push button 61 must be actuated to drive the carriage toward the on position. When the bracket 73 is extended to the point where the bracket 73 reaches the end of the elongated slot 89 (see FIG. 6), the bracket will be pulled free of the male portion 75 and the spring 95 will retract the bracket against the flange 91 of the carriage assembly 21 as shown in FIG. 7*e*. Thus, while the invention permits the operator to make one attempt to reset the circuit breaker from the trip position, repeated unsuccessful attempts are prevented, and the user will eventually have to go through the on position in order to make additional attempts to reset the circuit breaker.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A motor operator for a circuit breaker having a handle moveable from an on position, through a trip position to an off position and beyond said off position to a reset position for resetting the circuit breaker following a trip, and wherein the handle is spring biased toward the trip position from the off position until the circuit breaker is reset, said motor operator comprising:

a carriage engaging said circuit breaker handle and mounted for reciprocal movement along a longitudinal axis for operating said handle between said on and said reset positions;

an electric motor for effecting said reciprocal movement of said carriage when energized;

a power circuit for energizing said electric motor including an off limit switch which is actuated by said carriage with said handle in said off position and reset position to deenergize said electric motor when said circuit breaker is reset, but which is normally unactuated when said handle and therefore said carriage rebound toward said trip position when the circuit breaker does not reset; and override means maintaining actuation of said off limit switch when said handle and therefore said carriage rebound toward said trip position when an attempt to reset said circuit breaker is unsuccessful.

2. The motor operator of claim 1 wherein said override means comprises a first member secured to said housing and a second member secured to said carriage which releasably engage to maintain said off limit switch actuated when said circuit breaker does not reset.

3. The motor operator of claim 2 wherein one of said first member and said second member comprises a first part of a releasable fastener and wherein the other of said first member and said second member comprises a bracket, means slidably mounting said bracket for movement parallel to said longitudinal axis, and a second part of said releasable fastener secured to said bracket, said first and second parts of said releasable fastener engaging as said carriage travels toward said reset position and remaining engaged as said carriage rebounds when said circuit breaker does not reset, with said bracket slidably extended to engage and maintain said off limit switch actuated, said first and second parts disengaging when said carriage is driven toward said on position by said electric motor to deactuate said off limit switch.

4. The motor operator of claim 3 wherein one of said first and second members is said first member secured to said housing, and said other of said first member and second member is said second member secured to said carriage with said means slidably mounting said bracket on said carriage.

5. The motor operator of claim 4 wherein said second means further includes biasing means biasing said bracket toward said carriage.

6. The motor operator of claim 5 wherein said means slidably mounting said bracket on said carriage comprises a slot in one of said carriage and said bracket extending parallel to said longitudinal axis, and guide means on the other of said carriage and said bracket engaging said slot.

7. The motor operator of claim 6 wherein said biasing means comprises a spring connected to said bracket and said carriage biasing said bracket to a retracted position relative to said carriage.

8. The motor operator of claim 7 wherein said bracket has an elongated section extending parallel to said longitudinal axis and having said slot therein, and a flange generally transverse to said elongated section, said second part of said fastener means being mounted on said flange.

* * * * *